US007465862B2

(12) United States Patent
Georgeff

(10) Patent No.: US 7,465,862 B2
(45) Date of Patent: Dec. 16, 2008

(54) PERCUSSION DRUM CONSTRUCTION

(76) Inventor: Alan Georgeff, P.O. Box 2842, Malibu, CA (US) 90265-7842

( * ) Notice: Subject to any disclaimer, the term of this patent is extended or adjusted under 35 U.S.C. 154(b) by 141 days.

(21) Appl. No.: 11/504,297

(22) Filed: Aug. 16, 2006

(65) Prior Publication Data

US 2008/0041214 A1 Feb. 21, 2008

(51) Int. Cl.
*G10D 13/08* (2006.01)

(52) U.S. Cl. ..... 84/411 R

(58) Field of Classification Search ..... 84/411 R
See application file for complete search history.

(56) References Cited

U.S. PATENT DOCUMENTS 3,865,003 A * 2/1975 Della-Porta ..... 84/411 R
7,119,263 B1 * 10/2006 Chen ..... 84/411 A
2004/0063821 A1 4/2004 Gomy et al. ..... 524/94
2006/0146228 A1 7/2006 Sogo et al. ..... 349/65
2006/0198999 A1 9/2006 Rudiger et al. ..... 428/327

FOREIGN PATENT DOCUMENTS

JP 2001-323149 11/2001
JP 2004-250557 9/2004
WO 2006/010581 A1 2/2006

* cited by examiner

*Primary Examiner*—Kimberly R Lockett
(74) *Attorney, Agent, or Firm*—William W. Haefliger

(57) ABSTRACT

A percussion drum assembly comprising, in combination an annular shell having a vertical axis, and upper and lower flanges extending toward that axis; upper and lower drum heads and annular retainers for the heads; vertically extending adjustment members operatively threadably connected to the flanges; and shoulders that are displaced vertically to bear on the retainers.

7 Claims, 6 Drawing Sheets

PERCUSSION DRUM CONSTRUCTION

BACKGROUND OF THE INVENTION

This invention relates generally to the construction of percussion drums and more particularly to easily formed metallic percussion drum shells.

Traditionally, drum shells have been constructed of wood and/or plastic, and considerable time and effort are required to form the shells into cylindrical shape. Also, the heads of drums had to be connected to the shells by adjustable elements at the outer sides of the shells, due to the structural limitations of wooden or plastic cylindrical shells. There is need for improvements in drum shells eliminating the disadvantages referred to.

SUMMARY OF THE INVENTION

It is a major object of the invention to provide improvements in drum shells which overcome the problems and disadvantages referred to. Basically, the improve percussion drum assembly of the invention includes:

a) an annular shell having a vertical axis, and upper and lower flanges extending toward that axis, b) upper and lower drum heads and annular retainers for the heads, c) vertically extending adjustment members operatively threadably connected to the flanges, d) shoulders that are displaced vertically by said members to transmit force to said retainers.

Additional objects include provision of a lightweight metallic shell that bears loading exerted between drum heads; provision of head tension adjustment members located at opposite ends of the shell and not at the outer side of the shell; direct and easily adjustable connection of the adjustable members to shell flanges, at opposite ends of the shell; whereby head tension is transmitted via the flanges through the main cylindrical body of the shell; provision of a clean visibly uncluttered external appearance of the main body of the cylindrical shell; cylindrical extensions from the flanges to provide axially directed alignment or guide surfaces for the head retainers, at opposite ends of the shell; and integration of the main cylindrical body of the shell, the flanges, and the guide surfaces into a one-piece, formed metallic unit.

These and other objects and advantages of the invention, as well as the details of an illustrative embodiment, will be more fully understood from the following specification and drawings, in which:

DRAWING DESCRIPTION

Figure 3:
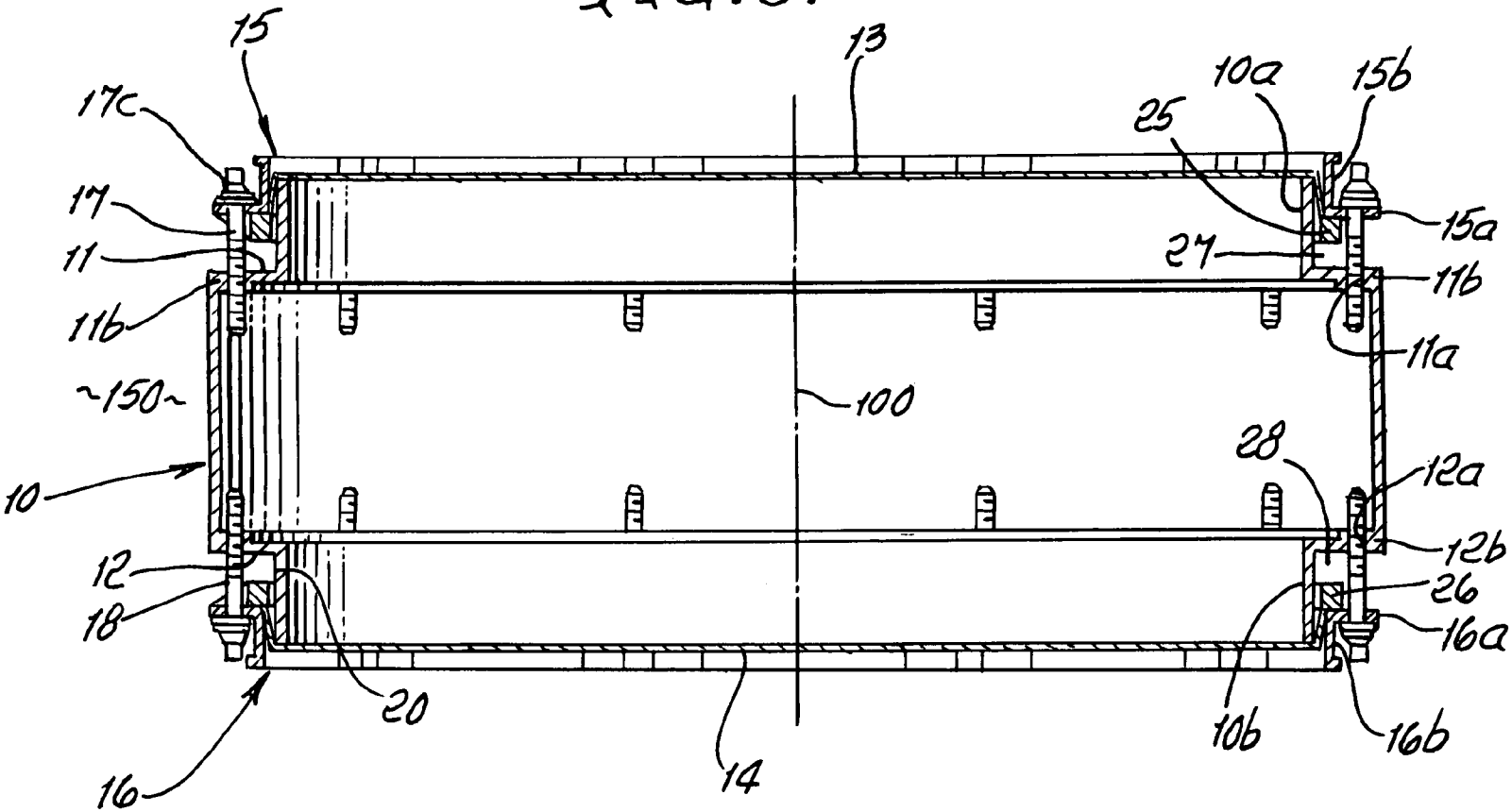
FIG. 3 is a section taken in elevation through the drum assembly.
Figure 3A:
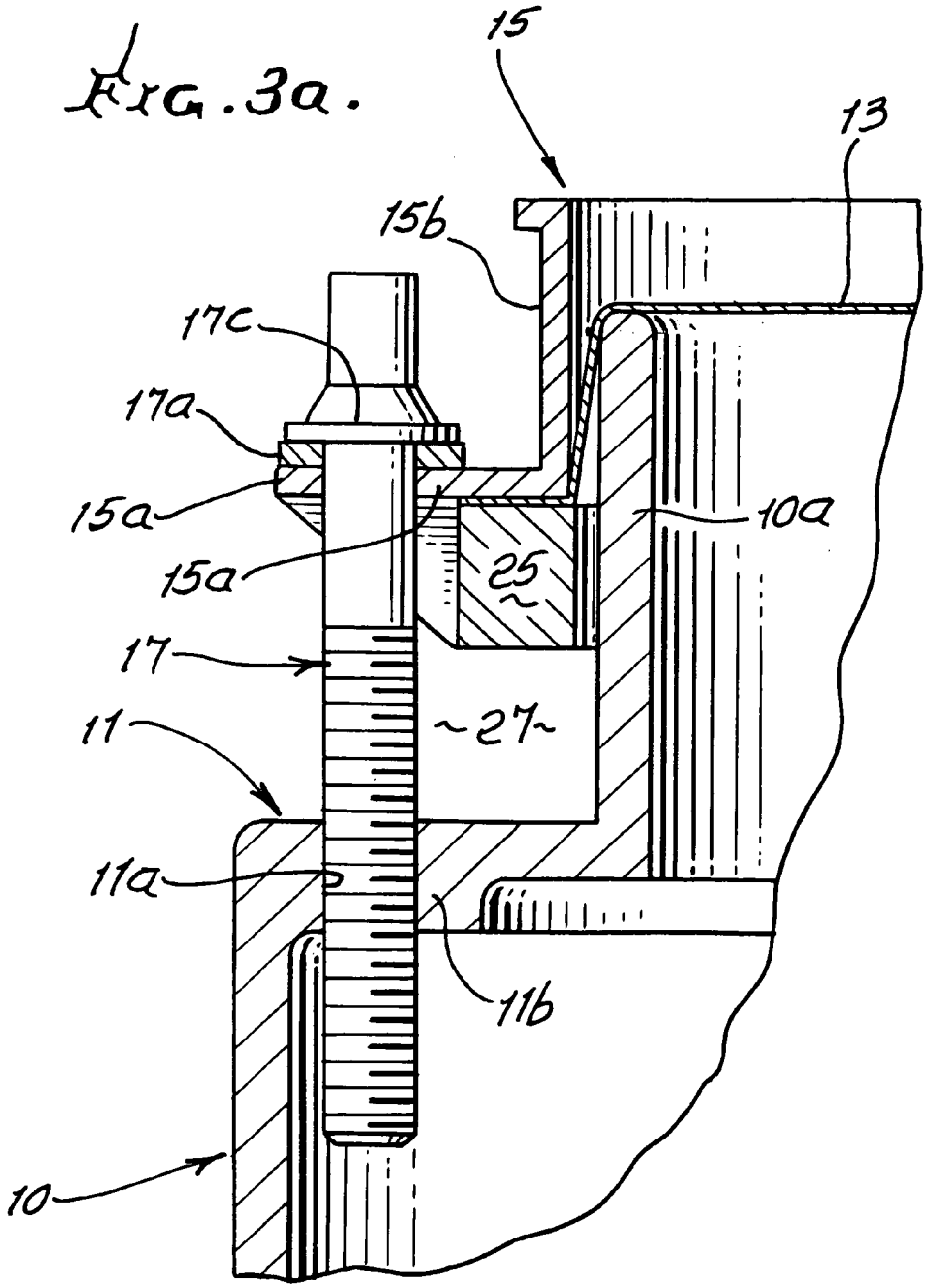
Figure 4:
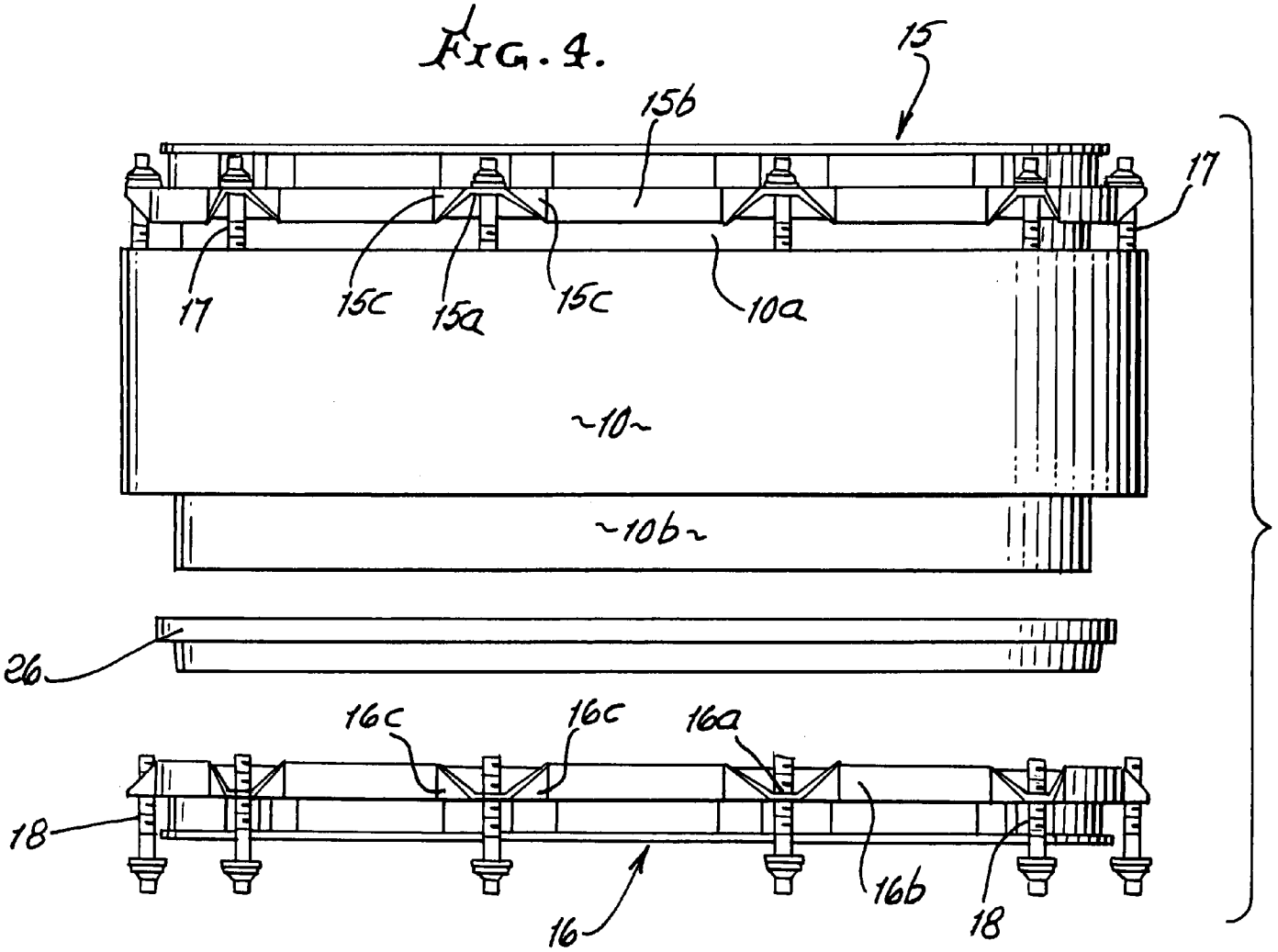

FIG. 3*a* is an enlarged fragmentary view showing details;

FIG. 4 is an exploded view of part of the drum assembly; and

Figure 5:
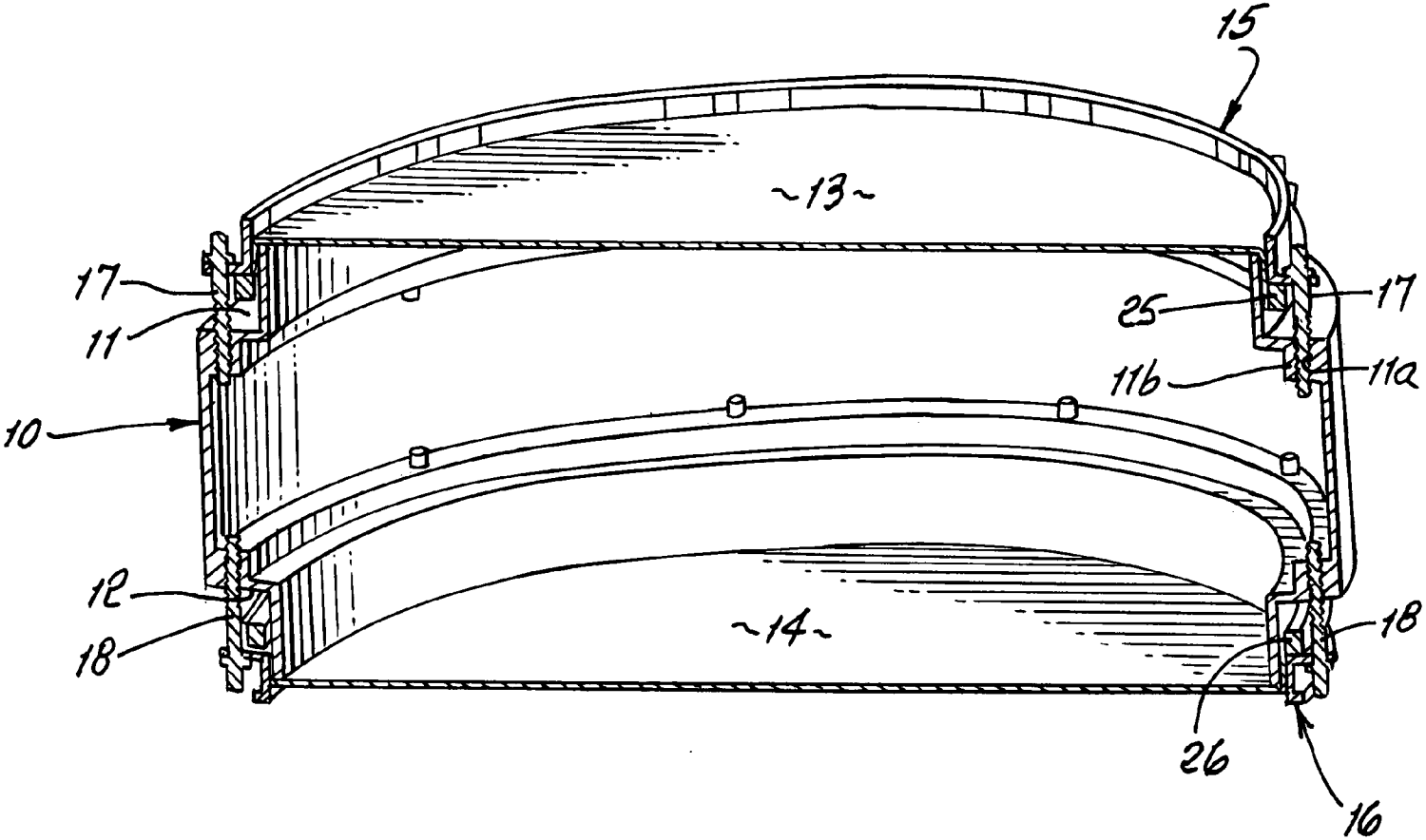

FIG. 5 is a perspective view taken in section through the drum assembly.

DETAILED DESCRIPTION

The percussion drum assembly shown comprises an annular shell 10 having a vertical axis 100 and upper and lower integral flanges 11 and 12 extending toward the axis; upper and lower drum heads 13 and 14 and annular retainers 15 and 16 for those heads; and vertically extending upper and lower adjustment members 17 and 18 operatively threadably connected to the flanges, the members having shoulders 17*a* and 18*a* displaced or positioned vertically to bear on the retainers, as for example on ledges thereon.

In the illustrated example, the shell including the flanges is metallic, and the flanges have threaded bores 11*a* and 12*a* in thickened flange extents 11*b* and 12*b*, receiving externally threaded extents of the members. Those members 17 and 18 are spaced about axis 100 and located within a cylindrical locus 20, defined by the outer surface of the shell. Members 17 and 18 project adjacent the inner surface of the shell 10, for compactness and strength.

Also provided are upwardly extending cylindrical extension 10*a* of the shell, and downwardly extending cylindrical extension 10*b* of the shell, whereby the shell, the flanges and the extensions 10*a* and 10*b* are unitary, to simplify and strengthen the assembly. Extensions 10*a* and 10*b* are spaced inwardly, toward axis 100. The upper annular retainer 15 extends downwardly between extension 10*a* and the threaded members 17; the lower annular retainer 10*b* extends upwardly between the extension 10*b* and the threaded members 18, and the outer cylindrical surfaces of the extensions 10*a* and 10*b* may advantageously provide guide surfaces for retainer vertical movement relatively toward one another as the members 17 and 18 are tightened or loosened.

Figure 1:
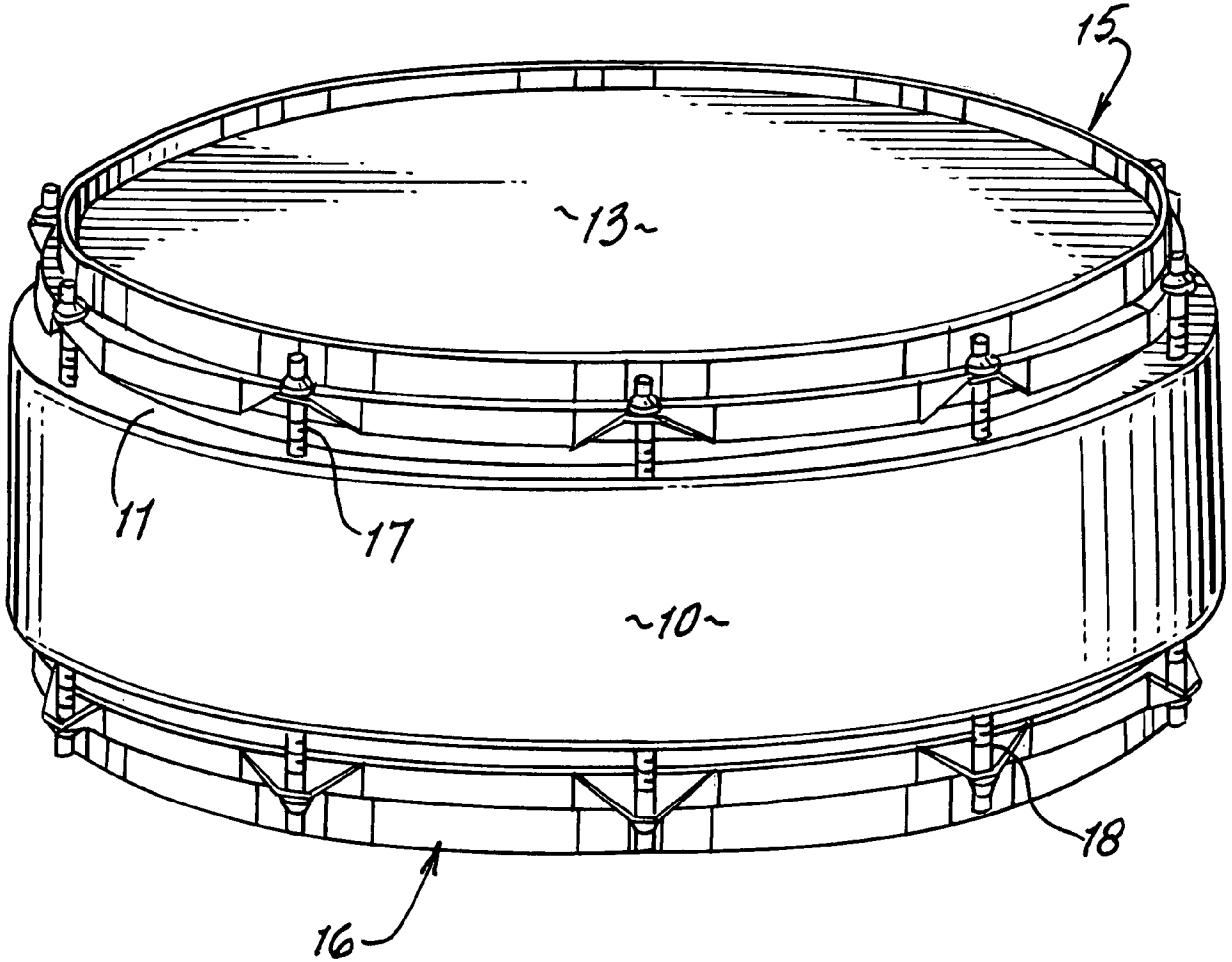
FIG. 1 is a perspective view of a preferred drum assembly.
Figure 2:
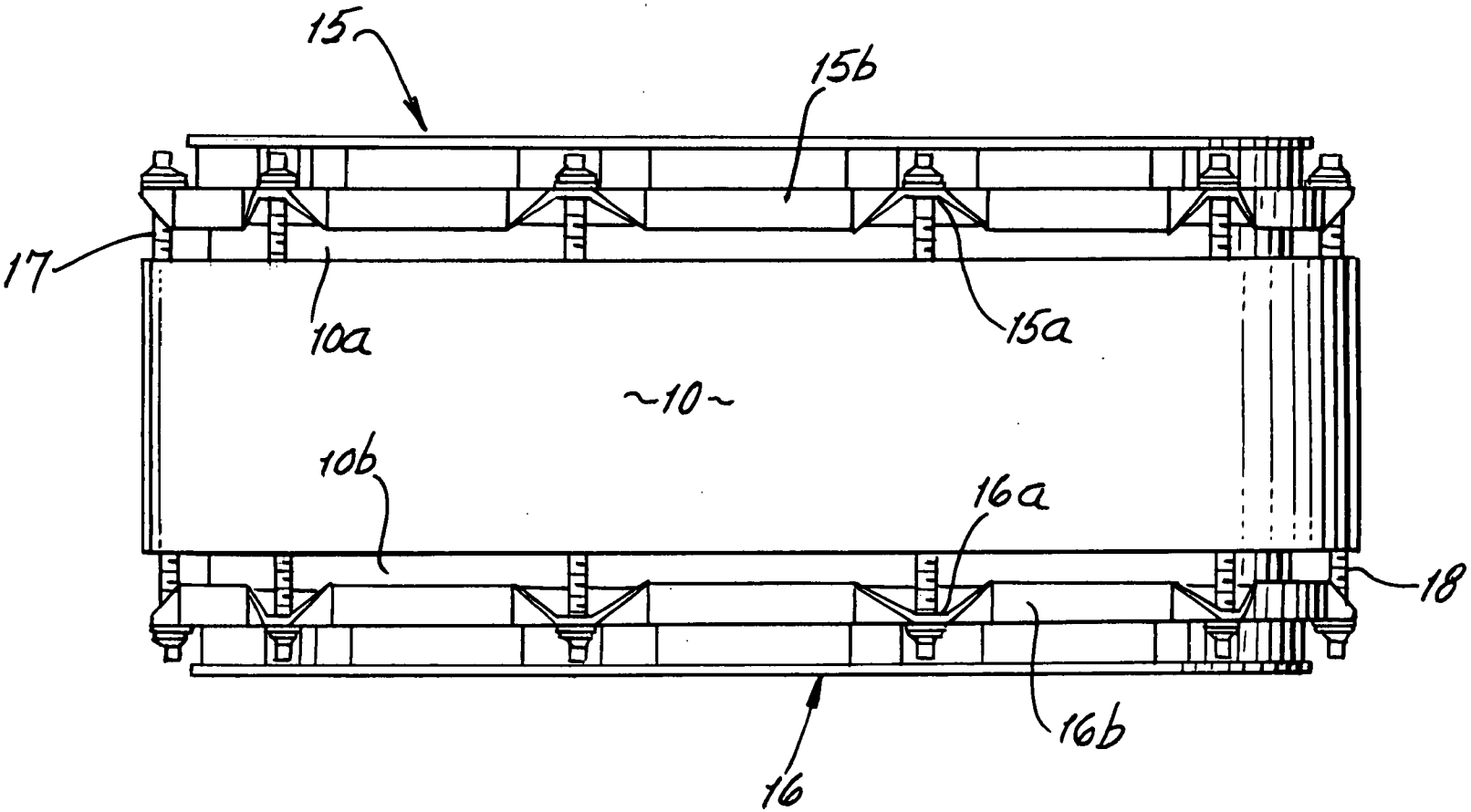
FIG. 2 is a front elevation showing the drum assembly.

It will be noted in FIGS. 2-4 that extensions 10*a* and 10*b* are visible as integral with the shell 10; and that the annular retainers 15 and 16 have local circularly spaced ledges 15*a* and 16*a*, radially outstanding from ring-shaped extents 15*b* and 16*b* of the retainers, with angled wedge shaped supports or braces 15*c* and 16*c* respectively interconnecting 15*a* with 15*b*, and 16*a* with 16*b*. Shoulders 17*c* on the members 17 and 18 transmit downward force, via elements 17*a* on ledges 15*a* to those ledges, and loading is transmitted via the angled braces to the ring-shaped extents of the retainers, in a highly compact, efficient, and structurally sound manner. The retainers transmit downward holding force to rings 25 and 26 protectively located in annular spaces 27 and 28 for tensioning the drum heads 13 and 14, attached to the rings. Rings 25 and 26 are urged axially by ledges 15*a* and 16*a*. A highly compact and protected assembly is provided.

Outer portions of the drum heads are held between the retainers and the extensions 10*a* and 10*b*.

Protruding ends of the members may be notched to receive a tool for rotating them.

It will be especially noted that the space 150 immediately outward of the shell is free of any head tensioning structure, whereby the drum has a "clean" appearance.

I claim:

1. A percussion drum assembly comprising, in combination:

a) an annular shell having a vertical axis, and upper and lower flanges extending toward that axis, b) upper and lower drum heads and annular retainers for said heads, c) vertically extending adjustment members operatively threadably connected to the flanges, d) shoulders that are displaced vertically to transmit force to said retainers, e) there being cylindrical extensions of the shell, projecting vertically from inward extents of the flanges, whereby the extensions, flanges and shell are unitary, f) and wherein the upper annular retainer projects downwardly between an upper extension and an upper adjustment member, and the lower annular retainer projects upwardly between a lower extension and a lower adjustment member.

2. The combination of claim 1 wherein the shoulders are on the adjustment members.

3. The combination of claim 1 wherein the shell is metallic, and the flanges have threaded bores receiving externally threaded extents of said members.

4. The combination of claim 1 wherein said adjustment members are located within a cylindrical locus defined by the shell, to project above and below said flanges.

5. The combination of claim 1 wherein the extensions have outer surfaces acting as guides for retainer movement, axially, in response to tightening of the adjustment members.

6. The combination of claim 1 wherein the members project through threaded bores in the flanges, and adjacent inner surfaces 10*d* of the shell.

7. The combination of claim 1 wherein the retainers have local circularly spaced ledges to receive force exerted by the shoulders, there being angled supports interconnecting the ledges and ring-shaped extents of the retainers.

* * * * *